US005227246A

United States Patent [19]

Ueda et al.

[11] Patent Number: 5,227,246

[45] Date of Patent: Jul. 13, 1993

[54] INK SHEET USABLE IN THERMAL RECORDING

[75] Inventors: Hiroo Ueda, Atsugi; Hiroshi Sasao, Kawasaki; Kohei Kiyota, Machida; Koji Uchiyama, Yokohama, all of Japan

[73] Assignee: Fujitsu Limited, Kawasaki, Japan

[21] Appl. No.: 952,193

[22] Filed: Sep. 28, 1992

Related U.S. Application Data

[63] Continuation of Ser. No. 700,900, May 13, 1991, abandoned, which is a continuation of Ser. No. 396,757, Aug. 22, 1989, abandoned, which is a continuation of Ser. No. 941,159, Dec. 12, 1986, abandoned.

[30] Foreign Application Priority Data

Dec. 18, 1985 [JP] Japan ..... 60-286354
Dec. 18, 1985 [JP] Japan ..... 60-286355
Sep. 17, 1986 [JP] Japan ..... 61-217327

[51] Int. Cl.[5] ..... B41M 5/26

[52] U.S. Cl. ..... 428/484; 428/195; 428/423.1; 428/474.4; 428/480; 428/913; 428/914

[58] Field of Search ..... 428/195, 201, 203, 207, 428/484, 488.1, 913, 914, 423.1, 474.4, 480

[56] References Cited

U.S. PATENT DOCUMENTS 3,330,791 7/1967 Mater et al. ..... 428/423.7
3,849,239 11/1974 Newman ..... 428/321.3
4,107,327 8/1978 Tilson et al. ..... 428/321.3
4,585,688 4/1986 Nakamura et al. ..... 428/488.1

FOREIGN PATENT DOCUMENTS 3507097 9/1985 Fed. Rep. of Germany ... 428/488.1
0190896 10/1984 Japan ..... 428/488.1
0120094 6/1985 Japan ..... 428/488.1
60-183192 9/1985 Japan ..... 428/195
60-187593 9/1985 Japan ..... 428/195
0236787 11/1985 Japan ..... 428/488.1

OTHER PUBLICATIONS

Patent Abstrcacts of Japan, vol. 11, No. 372 (M-648) [2819], Dec. 4, 1987, p. 68 M 648; & JP-A-62 144 996 (Fujitsu Ltd.) Jun. 29, 1987.

Patents Abstracts of Japan, vol. 11, No. 368 (M-647) [2815], Dec. 2, 1987, p. 99 M 647; & JP-A-62 142 690 (Fujitsu Ltd) Jun. 26, 1987.

*Primary Examiner*—Pamela R. Schwartz
*Attorney, Agent, or Firm*—Staas & Halsey

[57] ABSTRACT

A reusable thermal ink sheet used for thermal printing has a thermal ink composition layer formed on a substrate. The thermal ink composition is a mixture of ink material and filler. The ink material includes a coloring agent and a low temperature melting compound which is a solid at room temperature and is melted during thermal printing in response to a printing image to be transferred. The low temperature melting compound contains a urethane compound as a base material and additive materials as viscosity modulators thereof which lower the viscosity of the ink material at printing temperature. The additive materials contain at least one material selected from the group consisting of fatty acid compounds, fatty acid amide compounds and ester compounds. The improved ink sheet assures a high quality printing image is transferred to a plain paper having a rough surface when thermal printing occurs ten times or more. In addition, ghost images are not formed and background noise is eliminated. Further, a plasticizer is added to the ink material described above, thereby improving the thermal printing ability at a low temperature.

19 Claims, 8 Drawing Sheets

INK SHEET USABLE IN THERMAL RECORDING

This application is a continuation of U.S. patent application Ser. No. 07/700,900, filed May 13, 1991, now abandoned, which is a continuation of U.S. patent application Ser. No. 07/396,757, filed Aug. 22, 1989, now abandoned which is a continuation of U.S. patent application Ser. No. 06/941,159, filed Dec. 12, 1986, now abandoned.

BACKGROUND OF THE INVENTION

The present invention relates to thermal recording (heat transfer recording) in which an improved thermal ink sheet or ribbon is repeatedly used for thermal recording. More particularly, the present invention relates to an improved thermal ink material.

As is well known, in a thermal recording process, an ink sheet, having a solid ink composition layer coated on a substrate such as a polyester film, is used. A thermal printing head contacts the substrate with pressure and transfers heat to the solid ink composition layer. The heat is selectively distributed onto the contact surface of the printing head corresponding to an image pattern to be reproduced. The heated solid ink material contained in the layer melts and adheres to the surface of a receiving sheet, i.e., printing paper, which contacts the ink sheet. Consequently, the image pattern is transferred onto the printing paper.

The thermal recording process is used in various information recording means, such as facsimiles, word processors, personal computers, automatic ticket issuing machines, etc. The thermal recording process has substantial advantages, such as low noise printing, compact size, low cost, and low running cost since plain paper is used as a receiving sheet. However, there are certain disadvantages.

In a prior art thermal process, a printed image is transferred onto a receiving sheet which is a smooth plain paper having a Bekk smoothness higher than 200 seconds. This is required in order to obtain clear printing quality. When using plain paper having a rough surface, the thermal solid ink material (hereinafter, simply referred to as "ink material") is required to increase its resinous components to strengthen the adhesion of the printed image onto the plain paper, or to improve its film forming ability and bridging property. As a result, the melting point of the thermal ink material rises, causing the printing ink sheet to have a lower printing sensitivity. Consequently, the printing energy is forced to be increased, resulting in a heavy load placed on the printing head and a short life thereof. Various counter measures have been employed including increasing the printing pressure of the thermal printing head onto the thermal ink sheet, improving the timing and peeling angle when the thermal ink sheet is peeled off the printing paper after the transfer of the printing image, and employing a printing head having an improved structure to achieve more sharp point contact between the printing head and the thermal ink sheet.

However, the biggest disadvantage of prior art thermal recording devices is the vast consumption of ink sheets. This is because for a single thermal recording step, all the ink material existing on the areas of the substrate of the ink sheet corresponding to the image pattern, is transferred, making it impossible to further use the ink sheet in a succeeding thermal recording step. An ink sheet of this type is referred to as "one-time" ink sheet, and is consumed each time the printing image is transferred to the printing paper. This increases the cost of the thermal recording process.

Recently, various types of reusable or "multi-time" ink sheets which can withstand repeated use have been developed to solve the above-described problems. Examples of "multi-time" ink sheets are disclosed, for example, in U.S. Pat. No. 3,392,042 issued on Jul. 9, 1968, to Hugh T. Findlay et al., Japanese Patent Laid-Open Provisional Application No. 57-160691 to Uchiyama et al., published on Oct. 4, 1982, and Japanese Patent Laid-Open Provisional Publication No. 58-183297 to Ohnishi et al., published on Oct. 26, 1983. Ink sheets in the above-identified references have a thermal ink composition layer, for example, a polyester film, disposed on a substrate. An ink composition layer contains a porous transfer layer therein, and ink material is contained in the pores of the porous transfer layer. When heat and pressure are applied to the ink sheet in the area corresponding to a recording pattern through contact with the associated printing head, the applied heat is transmitted through the substrate to raise the temperature of the ink material and to melt the ink material, thereby decreasing its viscosity. The heated ink material flows easily through the porous structure of the transfer layer, being expressed by the pressure applied toward the printing paper, and penetrating thereinto. The porous structure of the transfer layer provides flow resistance, limiting the quantity of the ink material which is expressed for a one time printinu. Thus, the thermal ink sheet is capable of being repeatedly used. Thereafter, the thermal printing ink sheet is peeled off the printing paper and the thermal recording process is completed.

The prior art reusable thermal printing ink sheet is three to five times thicker than that of a one-time thermal printing ink sheet. This is necessary in order to withstand the repeated thermal printing operation. However, this causes a decrease in the printing sensitivity of the device and requires an increase in the printing energy. Particularly, when a plain paper having a rough surface is used, more resinous ink material having a higher melting point and higher viscosity is required in the ink composition layer as described above. In a cold environment, therefore, such reusable thermal printing ink sheets are not usable in a conventional thermal printing apparatus.

Furthermore, prior art multi-time thermal printing ink sheets have other problems including background noise and the transfer of a ghost image onto the printing paper. The background noise is caused by the type of surface of the associated ink sheet. A powdery and adhesive surface of the ink sheet adversely affects printing. A printing paper is contaminated only by the friction between the surfaces of the relevant ink sheet and printing paper during a storage or printing operation. Accordingly, background noise is found in prior art "one-time" and "multi-time" ink sheets.

The ghost image is caused by the brittleness of the solid ink material. FIG. 1 has enlarged cross-sectional views of an ink sheet and plan views of images transferred onto a printing paper, illustrating the various states of the surfaces of the printing paper (upper row), the ink composition layer (middle row) and the cross-section of the ink composition layer (lower row), before printing, after printing, and during succeeding printing stages when printing pressure, but no printing signal, is applied (blank printing), respectively. As shown in the cross-sectional views, a substrate 1 is coated with an ink composition layer 3 which is a porous layer formed of coagulated carbon powders 4. Ink material 5, stored in the pores of the porous structure, contains low temperature melting compounds (waxes) and coloring agents. After an image is transferred onto the paper, an originally smooth surface of the ink layer 3 is roughened when the ink sheet is peeled off the printing paper 10. This results in micro-peaks 6 which are formed by half melted viscous ink material pulled in a direction normal to the surface of the ink sheet. The peaks 6 are distributed in the form of an inverse image 8.

If the ink material 5 is brittle in its solid state, that is, at room temperature, the peaks 6 are easily collapsed and tend to be transferred to the printing paper 10 when a printing pressure of the printing head (represented by a pressing roller 11) is applied to the ink sheet at a next printing step. As a result, a faint image 4 is left on the paper 10. The faint image 4 is referred to as a ghost image. If a new pattern is printed at a succeeding step, the new pattern image and the ghost image 4 are transferred onto the same portion of the printing paper 10. Thus, the printing quality is lowered. The background noise and the ghost image are found frequently in prior art thermal recording processes employing ink sheets which include low temperature melting compounds such as fatty acid compounds, fatty acid amide compounds, and ester compounds, because these materials are brittle or have powdery surfaces in their solid states.

Further, an ink sheet containing a low temperature melting compound of urethane having (NHCO) atomic bonding is proposed. The urethane compound features a narrow and sharply distinguishable melting temperature zone, resulting in a clearly printed image. On the other hand, thermal ink material containing a urethane compound has a strong adhesion force to paper and is substantially viscous near its melting temperature. When the ink sheet, including the urethane compound, is repeatedly used some background noise is present which is due to the high viscosity of the urethane compound. When the ink sheet is peeled off the printing paper just after the transfer of the printing image, the ink material is in a half melted state and leaves substantially sharp and elongated peaks of the solid ink material. Such elongated peaks collapse very easily, even though the urethane compound is not brittle, causing a ghost image on the printing paper. In addition, the resulting transferred image is a non-uniform printed image which has a rather low optical density and which has many white spots where no ink material is locally transferred. Thus, a non-uniform printed image which has a low optical density results. The non-uniform printed image is also due to the high viscosity of the ink material. Furthermore, the melting point is also high, requiring large printing energy and the use of relatively smooth plain paper as a receiving sheet.

Accordingly, an ink sheet containing a urethane compound is not suitable for a reusable multi-time ink sheet. Thus, a further improved thermal recording ink sheet has been expected in the field.

SUMMARY OF THE INVENTION

It is an object of the present invention to provide an improved reusable thermal recording ink sheet which does not cause ghost images on a printing paper during a thermal recording process.

It is another object of the present invention to provide an improved reusable thermal recording ink sheet which is capable of transferring a printing image onto plain paper having a relatively rough surface.

It is still another object of the present invention to provide an improved reusable thermal recording ink sheet which performs a thermal recording operation even in a cold environment.

According to the present invention, in order to attain the objects described above, a thermal recording ink sheet is provided, wherein an ink composition layer is formed on a substrate of polyester. The ink composition comprises fine carbon powders as filler, and a solid ink material which is in a solid state at room temperature and is soluble at fairly low heating temperatures. The solid ink material is referred to as ink material. The ink material contains a low temperature melting compound and coloring agent which are soluble with respect to each other. The low temperature melting compound is composed of a urethane compound as a base material and one or more additive materials selected from ester compounds, fatty acid amide compounds, and fatty acids. Generally, these compounds are wax-like materials, and will not be further described. The fine carbon powder filler, referred to as carbon black, tends to coagulate to form a porous layer and accommodates the ink material in the pores of the porous layer as described above. When the ink sheet is heated, and the ink material is melted and becomes fluid, the fluid ink material is expressed from the pores by pressure provided by a printing head and is transferred onto a printing paper. Thus, the porous layer acts as a transfer control layer.

With respect to the ink material according to the present invention, the advantage of employing urethane compounds is that they are not brittle at the solid state stage and therefore background noise ia prevented. The disadvantage is that urethane compounds have rather high melting points and high viscosities in their melted state causing low optical density of the transferred printing image. This is compensated for in the present invention by providing additive materials. The additive materials, such as ester compounds, fatty acids and fatty acid amide compounds, act as viscosity modulators of the associated ink material in the melted state, lowering the viscosity of the urethane compound. The viscosity of the ink material of the present invention at a printing temperature is fairly low compared with the prior art. Thus, the melted ink material has flowability sufficient to make the ink material flow and reach the surface of the printing paper even though the surface of the paper is rather rough and uneven. The flowing ink material penetrates into the paper to some degree so that a film adheres to the surface of the paper.

As a result, the ink sheet according to the present invention assures a clear and uniform thermal printing image with satisfactory optical density and no ghost image. Furthermore, rough plain paper can be employed as a printing paper. It is confirmed that the printing ink sheet according to the present invention can withstand repeated thermal printing processes of more than ten times with satisfactory printing quality. These features and advantages will be subsequently apparent as more fully hereinafter described and claimed, reference being had to the accompanying drawings.

DESCRIPTION OF THE PREFERRED EMBODIMENTS

In the following description, seven embodiments of the present invention will be described. Regarding these embodiments, reference will be made to Table 1, wherein the various materials added to a low temperature melting compound in respective embodiments are tabulated. Individual description of the data is omitted.

Figure 1:
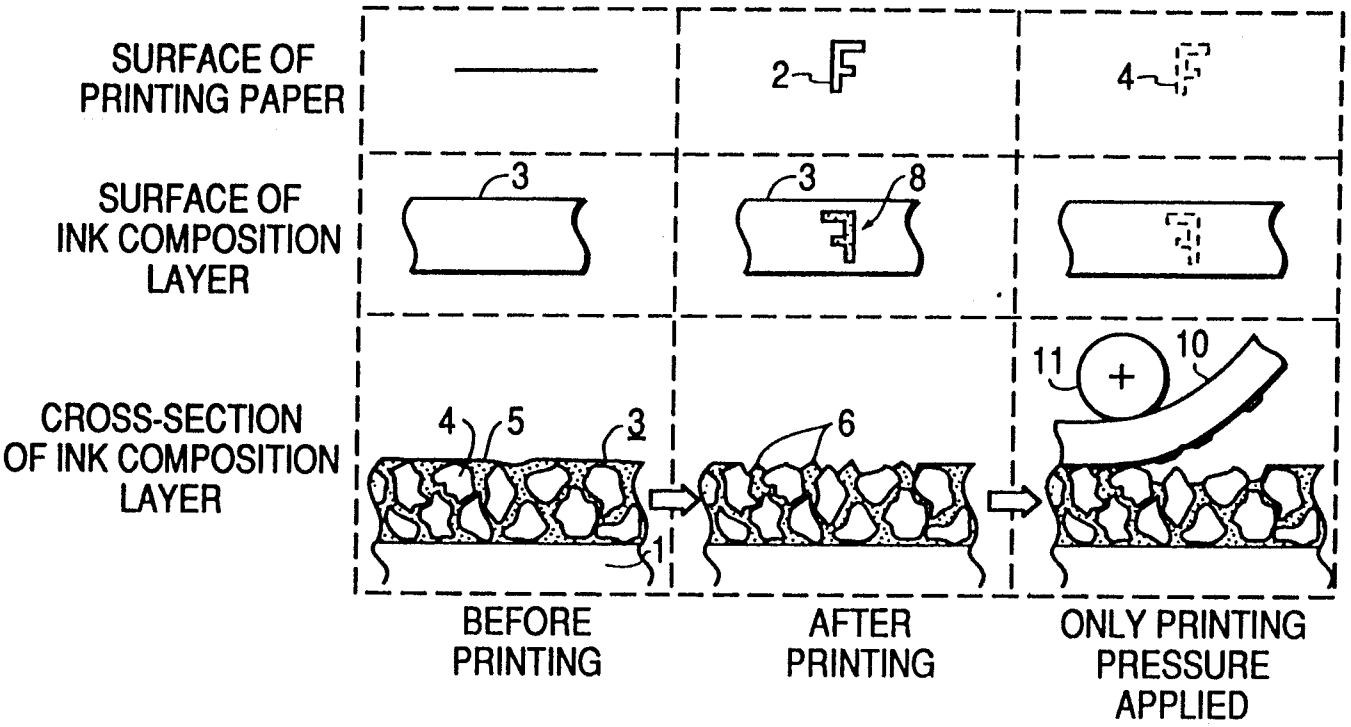
FIG. 1 are enlarged cross-sectional views of an ink layer, and plan views of an ink sheet, and images transferred onto a printing paper, illustrating the occurrence of a ghost image.
Figure 2:
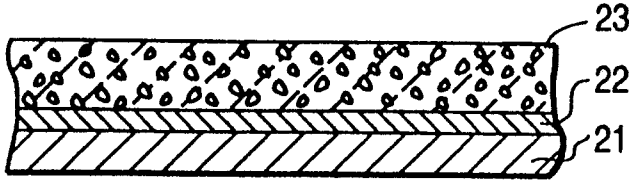
FIG. 2 is a cross-sectional view of a reusable ink sheet of a first embodiment according to the present invention.

FIG. 2 is a cross-sectional view of a reusable ink sheet of a first embodiment according to the present invention. As shown in FIG. 2, an ink sheet has a substrate 21 which is a polyester film 6 μm thick. An intermediate layer 22, 3 μm thick, formed of polyester resin and polyamide resin, is formed on the polyester film substrate 21. A solid ink composition layer 23 10 μm thick is formed on the intermediate layer 22. Good adhesion between the substrate 21 and the solid ink composition layer 23 is maintained by the intermediate layer 22. The polyester film substrate 21 can be any material as long as it can withstand the heat of the thermal printing head. That is, any conventional material which does not soften, melt, or deform upon contact with the heated thermal printing head may be employed. The materials conventionally used include polyester film, polyamide film, polycarbonate film, and other polymeric films, condenser papers, and other thin papers. The intermediate layer 22 prevents the solid ink composition layer 23 from coming off the surface of the substrate 21 when the ink sheet is heated. The material of the intermediate layer 22, therefore, must be coated very thinly and adhere to both the substrate 21 and the solid ink composition layer 23. In view of this, polyester resin or polyamide resin is most suitable.

The second to seventh embodiments of the present invention, described hereinafter, have the same ink sheet structure as described above with respect to the first embodiment and FIG. 2. Accordingly, further description thereof is omitted unless otherwise mentioned. The feature of the ink sheet according to the present invention is the composition of the ink material in the ink composition layer 23.

The ink composition layer 23 according to a first embodiment is prepared by blending thoroughly the following components:

| | |
|---|---|
| coloring agent: | Kayaset Black (product of Nippon Kayaku LTD) 1 part by weight; |
| low temperature melting compounds: | |
| urethane compound: | two parts by weight |
| ester compound: | Carnauba Wax (product of Nikko Fine Products LTD) main component: cerotic acid ester 0.1 to 1 part by weight; |
| paraffin compound: | (product of Nippon Seiro LTD) 1 part by weight; |
| filler: | carbon black (product of Tokai Carbon LTD) 0.5 parts by weight; and |
| solvent: | acetone. |

Figure 3:
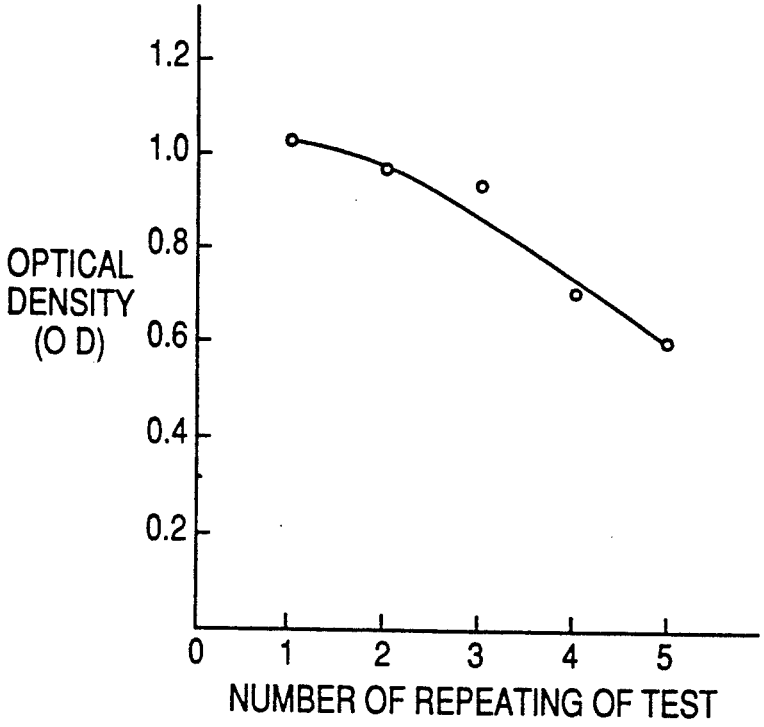
FIG. 3 is a graph of the results of repeated printings using a thermal solid ink sheet according to the first embodiment of the present invention, wherein the optical density OD is plotted along the ordinate and the repeating time is plotted along the abscissa.

The reusable ink sheet of the first embodiment is formed as a ribbon ink sheet and is tested with a conventional serial thermal printing machine employing a printing paper, such as a Xerographic paper of PA4 type, a product of Kishu Seishi LTD, having a rougher surface (having a Bekk smoothness of 60 seconds) than ordinary high quality thermal printing paper (having a Bekk smoothness of 250 seconds). The printing energy employed is 30 mJ/mm$^2$, and the printing pulse width is 1 ms. The result of the repeated printing test using a thermal solid ink sheet of the first embodiment is illustrated in FIG. 3 wherein the optical density OD of the printed images is plotted on the ordinate and the repeating time is plotted on the abscissa. The printing image pattern is a solid area which is repeatedly printed on the Xerographic paper using the same portion of the solid ink sheet being tested. The OD value starts from approximately 1.0 and decreases to approximately 0.6 after printing five times. This implies that the ink material, including the urethane compound mixed with the ester compound, has an improved film formation ability, resulting in a high optical density of the printed images and the elimination of a ghost image.

Figure 4:
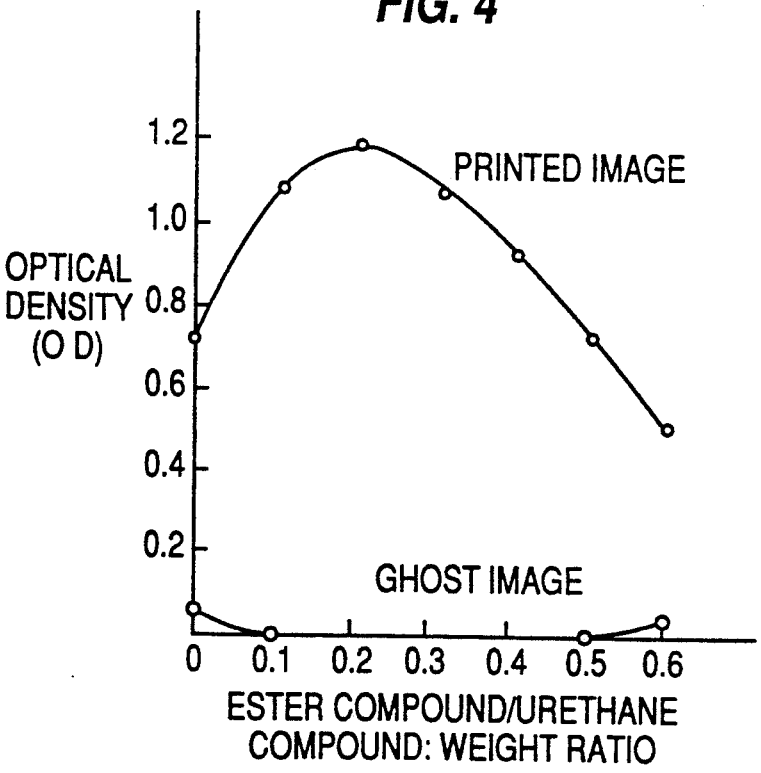
FIG. 4 is a graph of the relationship between the weight ratio of ester compound to urethane compound and the optical density OD of a printed image transferred onto a printing paper using an ink sheet according to the first embodiment of the present invention.

FIG. 4 is a graph of the relationship between the weight ratio of ester compound to urethane compound and the optical density OD of the printed image transferred onto a printing paper using the relevant ink material. The maximum optical density of the printed image is obtained at a weight ratio of 0.2, which is where uniform, clear printing images are achieved. Without the addition of an ester compound, that is, with the ink material containing only urethane compound as the low temperature melting compound, the optical density is substantially lower. For a weight ratio higher than 0.5 and lower than 0.1, a ghost image phenomenon arises. A low temperature melting compound, therefore, having a weight ratio of ester compound to urethane compound ranging from 0.1 to 0.5 is preferable. The decrease in the optical density OD at a weight ratio over 0.3 is due to low mutual solubility between the coloring agent and the ester compound.

As described above, the structure of the solid ink sheet of a second embodiment is the same as that of the first embodiment. As an additive material to the low temperature melting compound, a fatty acid amide compound is used instead of the ester compound of the first embodiment. The blending composition of the material of the ink composition layer 23 in the second embodiment is as follows:

| | |
|---|---|
| coloring agent: | Kayaset Black (product of Nippon Kayaku LTD) 1 part by weight; |
| low temperature melting compounds: | |
| urethane compound: | 2 parts by weight; |
| fatty acid amide compound: | (product of Nippon Yushi LTD), 0.1 to 1 part by weight; |
| paraffin compound: | (product of Nippon Seiro LTD). 1 part by weight; |
| filler: | carbon black (product of Tokai Carbon LTD) 0.8 parts by weight; and |
| solvent: | acetone. |

Figure 5:
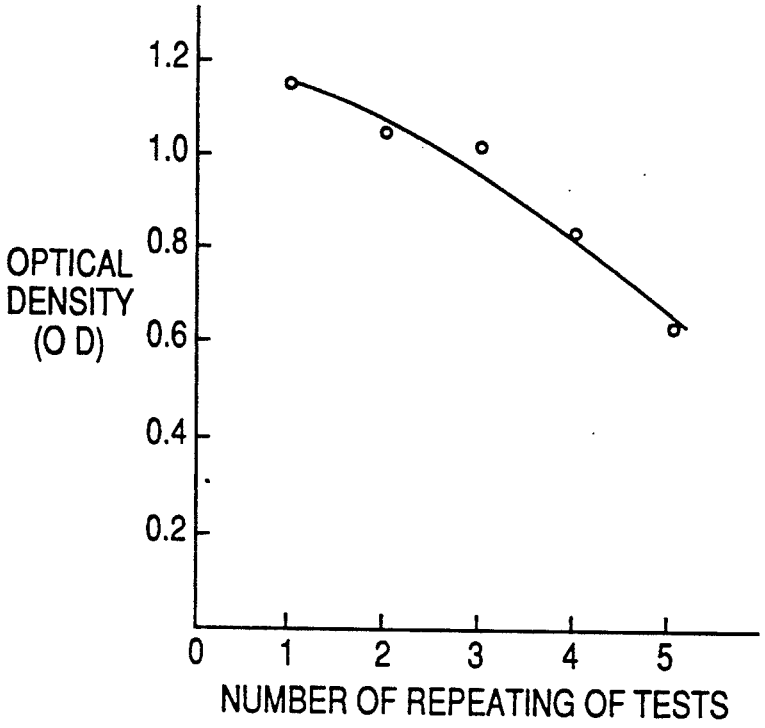
FIG. 5 is a graph of the results of a repeated printing test employing an ink sheet according to a second embodiment of the present invention.

Forming the solid ink sheet as a ribbon sheet, the repeated printing test of a solid ink sheet of the second embodiment is conducted in the same manner as that of the first embodiment. The pattern of the printing image is also a solid area. The result illustrated in FIG. 5 is similar to that of the first embodiment illustrated in FIG. 3.

Figure 6:
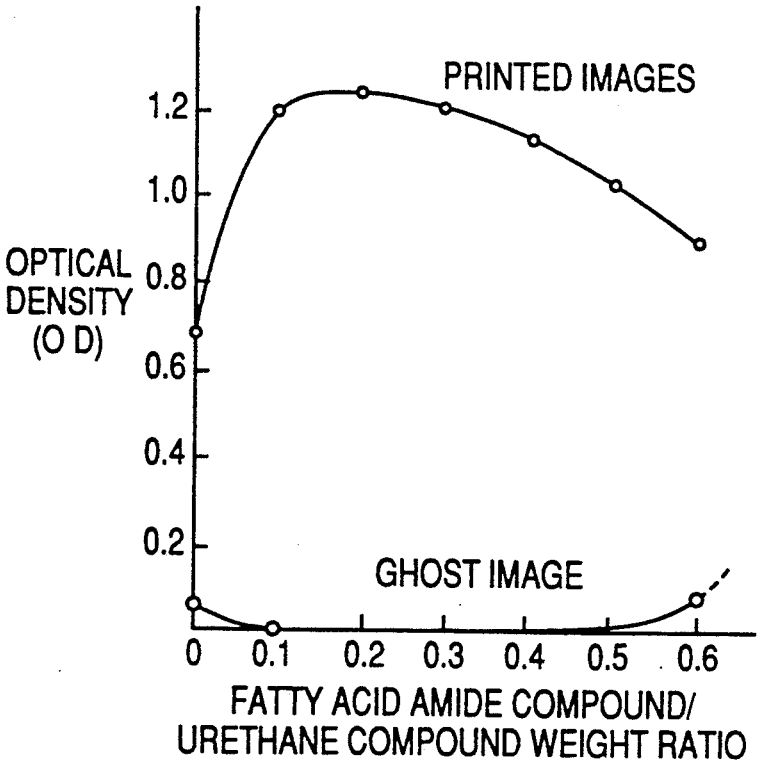
FIG. 6 is a graph of the relationship between the weight ratio of fatty acid amide compound to urethane compound and the optical density OD of a printed image transferred onto a printing paper using an ink sheet according to the second embodiment of the present invention.

FIG. 6 is a graph of the relationship between the weight ratio of fatty acid amide compound to urethane compound and the optical density OD of a printed image transferred onto a printing paper using the relevant ink material. The maximum optical density of the printed image is obtained at a weight ratio of 0.2, and uniform, clear printing images are achieved. Without the addition of a fatty acid amide compound, that is, with an ink material containing only urethane compound as the low temperature melting compound, the optical density is substantially lower. For a ratio lower than approximately 0.1 and higher than 0.5, ghost images and background noise arise and the optical density falls below 0.9. A weight ratio ranging from 0.1 to 0.5, therefore, is preferable.

The structure of a solid ink sheet of a third embodiment is the same as that of the first embodiment. A fatty acid is the additive material to the low temperature melting compound, rather than an ester compound as in the first embodiment. The composition of the ink composition layer 23 of the third embodiment is as follows:

| | |
|---|---|
| coloring agent: | Kayaset Black (product of Nippon Kayau LTD), 1 part by weight; |
| low temperature melting compounds: | |
| urethane compound: | (product of Nippon Yushi LTD) 2 parts by weight; |
| fatty acid: | main component: stearic acid 0.1 to 1 part by weight; |
| paraffin compound: | (product of Nippon Seiro LTD) 1 part by weight; |
| filler: | carbon black (product of Tokai Carbon LTD) 0.5 parts by weight; and |
| solvent: | acetone. |

Figure 7:
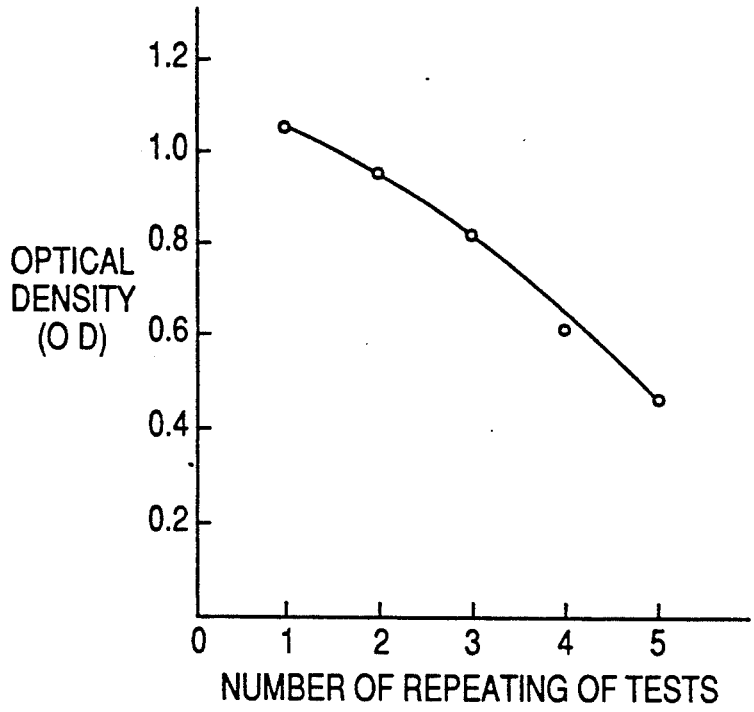
FIG. 7 is a graph of the results of a repeated printing test employing an ink sheet according to a third embodiment of the present invention.

A repeated printing test of the solid ink sheet of the third embodiment is conducted in the same manner as that of the first embodiment. The pattern of the printing image is also a solid area. The result illustrated in FIG. 7. is substantially similar to that of the first embodiment shown in FIG. 3. The decrease in the optical density OD of the printed image is sharper at approximately 0.5 after printing five times. However, the feature of the third embodiment is the low viscosity and low melting temperature of the ink material (refer to Table 1). This implies the effectiveness of further application of the fatty acid compounds to the solid ink material.

In the solid ink sheets of the preceding embodiments, a single material is added to the urethane compound of the low temperature melting compound. In the following embodiments, two materials are added to the solid ink material.

The structure of the solid ink sheet of a fourth embodiment is the same as that of the first embodiment. The additive material includes the combination of a fatty acid amide compound and an ester compound. The composition of the material of the ink composition layer 23 of the fourth embodiment is as follows:

| | |
|---|---|
| coloring agent: | Kayaset Black (product of Nippon Kayaku LTD) 1 part by weight; |
| low temperature melting compounds: | |
| urethane compound: | 2 parts by weight; |
| fatty acid amide compound: | Diamid 0-200 (product of Nippon Kasei LTD) 0.5 parts by weight, main component oleic acid amide; |
| ester compound: | Carnauba Wax (product of Nikko Fine Products LTD) 0.5 parts by weight; |
| paraffin compound: | (product of Nikko Fine Products LTD) 0.5 parts by weight; |
| filler: | carbon black (product of Nippon Kayaku LTD) 0.5 parts by weight; and |
| solvent: | acetone. |

Figure 8:
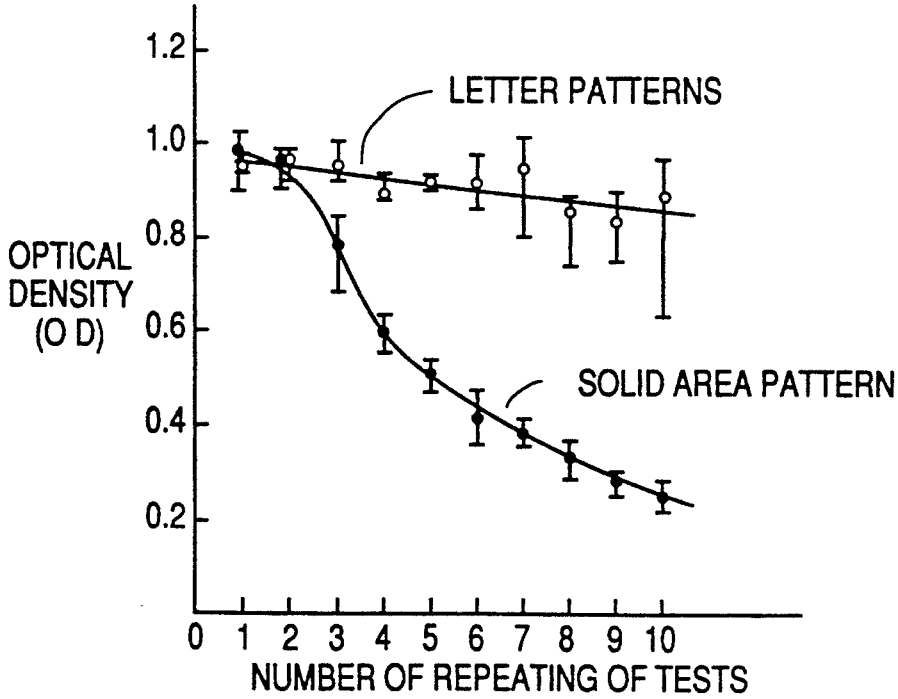
FIG. 8 is a graph of the results of a repeated printing test employing an ink sheet according to a fourth embodiment of the present invention.

Forming the solid ink sheet as a ribbon sheet, the repeated printing test of the solid ink sheet of the fourth embodiment is conducted in the same manner as that of the first embodiment. The patterns of the printing image are solid areas and ordinary Japanese characters printed at random. The results are illustrated in FIG. 8. Using a solid area pattern, the resulting optical density OD of the printed image decreases from 1.0 at its first printing to 0.5 at the fifth printing. However, using ordinary Japanese character images, the optical density OD of the relevant image decreases only slightly and can be maintained at approximately 0.9, which is satisfactory in practical use, even after a tenth printing. The ghost image is completely eliminated, achieving high quality printing with uniform optical density of printed characters and elimination of "white spots" (partially non-transferred portions of printed images).

With respect to the fourth embodiment, several other compositions of the low temperature melting compound are proposed. As for fatty acid amide compounds, instead of Diamid 0-200, the following components can be employed for obtaining a good printing image: erucic acid amide (commercially available as Alflow P-10 which is a product of Nippon Yushi LTD), N-stearyl oleic acid amide (commercially available as Nikkaamaido SO which is a product of Nippon Kasei LTD), and ricinoleic acid amide (commercially available as Diamid H which is a product of Nippon Kasei LTD). As for ester compounds, instead of carnauba wax, the following components can be employed for obtaining good results: beeswax, stearyl behenate (product of Nippon Yushi LTD), and cane sugar fatty acid (commercially available as Sugar Wax FA-10E which is a product of Dai Ichi Industry LTD).

Figure 9:
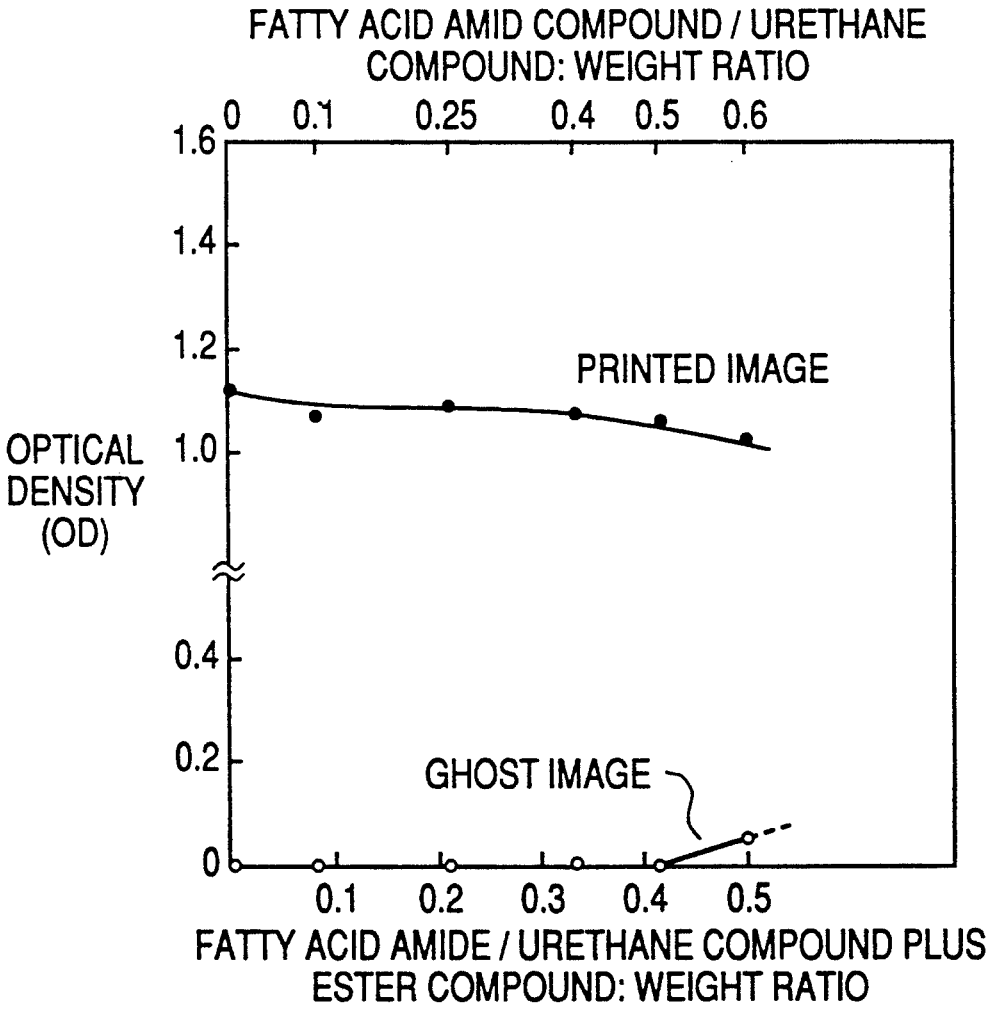
FIG. 9 is a graph of the relationship between the weight ratio of fatty acid amide compound to urethane compound or the weight ratio of fatty acid amide compound to urethane compound plus ester compound and the optical density OD of a printed image transferred onto a printing paper using an ink sheet according to the fourth embodiment of the present invention.

FIG. 9 is a graph of the relationship between the weight ratio of the fatty acid amide compound to the urethane compound or the weight ratio of fatty acid amide compound to the urethane and ester compounds, and the optical density OD of a printed image transferred onto a printing paper using the relevant ink material. The weight ratio of the ester compound to the urethane compound is maintained at 0.2. The optical density OD of the printed image is over 1.0 for a weight ratio of fatty acid amide compound to urethane compound in a range of 0 to 0.6. However, a ghost image phenomenon appears when the weight ratio is higher than 0.5, implying that the excess addition of the fatty acid amide compound makes the solidified ink material brittle. Therefore, a weight ratio not higher than 0.5, is preferable. The viscosity of the ink material in its melting state, for example, 75° C., is fairly low resulting in a uniform printed image.

The structure of a solid ink sheet according to a fifth embodiment is the same as that of the first embodiment. The fatty acid amide compounds added to the low temperature melting compound of the preceding fourth embodiment are replaced by fatty acid such as myristic acid, palmitic acid, stearic acid, and behenic acid. That is, the additive to the low temperature melting compound of the ink composition layer 23 includes ester compounds and fatty acids. With respect to ink sheets employing solid ink materials including the additive agents described above, the same evaluating tests as those of the first embodiment were performed with satisfactory results. An optical density above 1.0 is achieved, and a uniform printing image is attained without spots even though Xerographic paper having a rough surface is used. In addition, no ghost image is formed.

The structure of a solid ink sheet according to a sixth embodiment is the same as that of the first embodiment. The ester compound added to the low temperature melting compound of the fourth embodiment is replaced by fatty acids such as myristic acid, palmitic acid, stearic acid, and behenic acid. That is, the additives to the low temperature melting compound of the ink composition layer 23 includes fatty acids and fatty acid amide compounds.

For example, the ink composition layer 23 according to the sixth embodiment is as follows:

| | |
|---|---|
| coloring agent: | Kayaset Black (product of Nippon Kayaku LTD), 1 part by weight; |
| low temperature melting compounds: | |
| urethane compound: | (product of Nippon Yushi LTD), 2 parts by weight; |
| fatty acid amide compound: | Diamid 0-200 (product of Nippon Kasei LTD) 0.5 parts by weight; |
| fatty acid: | $C_{14}$ to $C_{22}$ (product of Nippon Yushi LTD) 0.5 parts by weight; |
| paraffin compound: | Paraffin Wax 145 F (product of Nikko Fine Products LTD) 0.5 parts by weight; |
| filler: | carbon black (product of Nippon Kayaku LTD) 0.5 parts by weight; and |
| solvent: | acetone. |

In the above description, $C_n$ designates an alkyl group having n atoms of carbon. For example, $C_{14}$ corresponds to myristic acid, $C_{16}$ corresponds to palmitic acid, $C_{16}+C_{18}$ corresponds to stearic acid, and $C_{22}$ corresponds to behenic acid. These fatty acid compounds may be added alone or in combination to the solid ink material. The same evaluating tests as those of the first embodiment are performed with a solid ink sheet according to the sixth embodiment with satisfactory results. An optical density OD above 1.0 is achieved, and a uniform printing image is attained on Xerographic paper having a rough surface. In addition, no ghost image is formed. The viscosity of the ink material at 75° C. is also fairly low as a result of the addition of a fatty acid (refer to Table 1).

However, with respect to an alkyl group below twelve ($C_{12}$ corresponding to lauric acid), the melting point is low, i.e., below 50° C., and background noise is caused by friction between the printing paper and the associated printing ink sheet. In contrast, when the number of carbon atoms in an alkyl group contained in the fatty acid is higher than twenty-four ($C_{24}$ corresponding to lignoceric acid), the melting point of the ink material greatly increases, requiring a large printing energy during a thermal printing operation, and therefore, background noise arises. Thus, fatty acids containing alkyl groups having a number of carbon atoms ranging from twelve to twenty-four are applicable to the ink material in the present invention.

Figure 10:
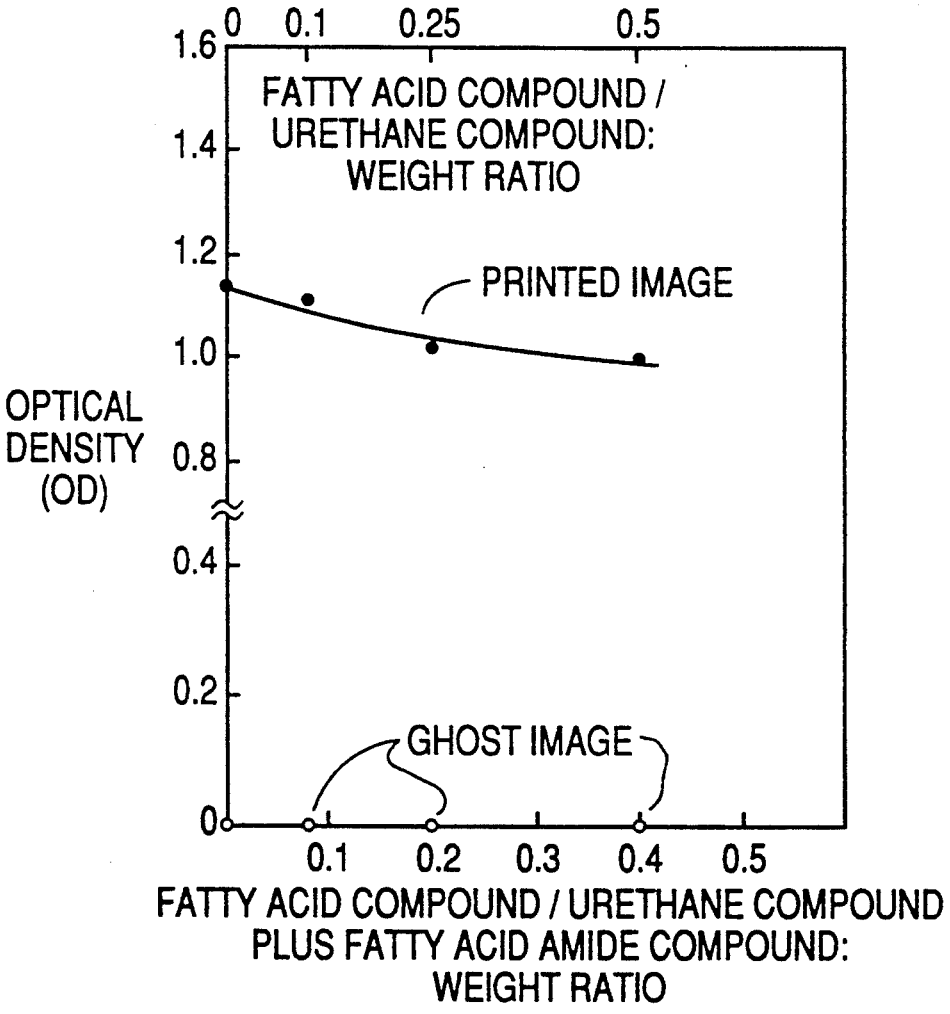
FIG. 10 is a graph of the relationship between the weight ratio of fatty acid compound to urethane compound or the weight ratio of fatty acid to urethane compound plus fatty acid amide compound, and the optical density OD of a printed image transferred onto a printing paper using the an sheet according to a sixth embodiment.

FIG. 10 is a graph of the relationship between the weight ratio of fatty acids (stearic acid) to urethane compounds (upper scale), or the weight ratio of fatty acids to urethane compounds plus fatty acid amide compounds (lower scale), and the optical density OD of a printed image transferred onto a printing paper using the relevant ink material according to the sixth embodiment. The weight ratio of the fatty acid amide compound to the urethane compound is maintained at 0.25. The optical density OD of the printed image is maintained above 1.0 for a weight ratio of fatty acids to urethane compounds within a range of 0 to 0.5. A ghost image is not formed for a weight ratio of fatty acids to urethane compounds ranging from 0 to 0.5 when the weight ratio of fatty acid amide compounds to urethane compounds is 0.25.

Figure 11:
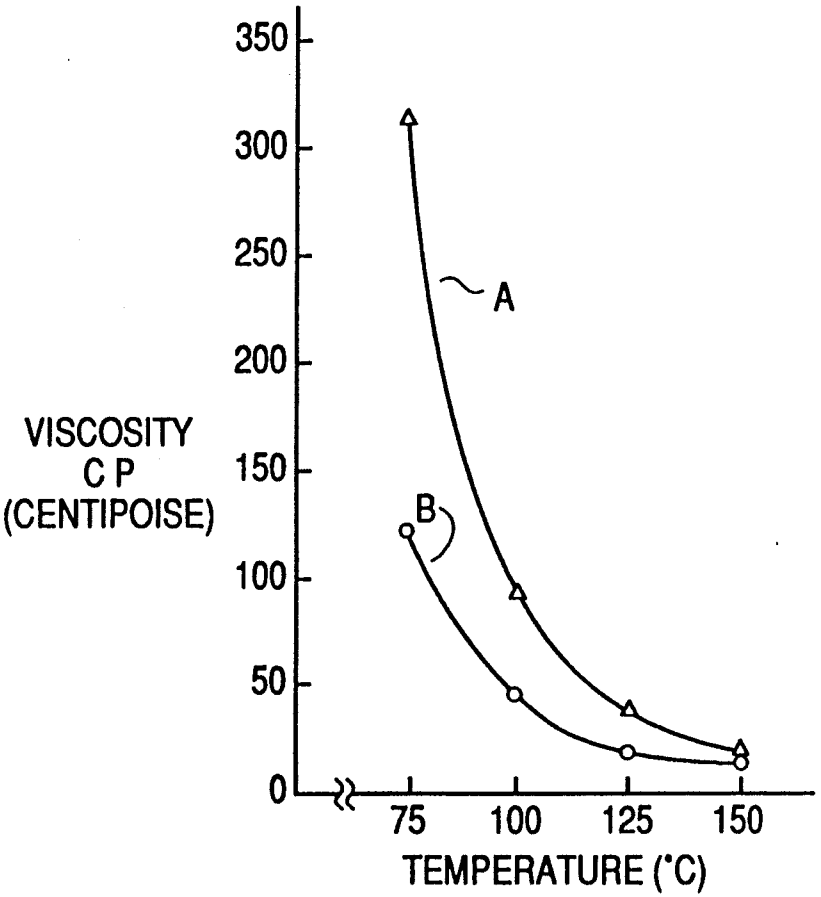
FIG. 11 is a graph of the viscosity characteristics of a solid ink material according to the sixth embodiment, illustrating the relationship between temperature and viscosity.

FIG. 11 is a graph of the viscosity characteristics of solid ink materials, illustrating the relationship between temperature and viscosity. Curve A illustrates the characteristics of an ink material without the addition of a fatty acid, and curve B illustrates the characteristics of an ink material with the addition of a fatty acid (stearic acid). From curves A and B the effect of the fatty acid for reducing the viscosity of the ink material is clearly seen, particularly at lower temperatures.

The structure of a solid ink sheet according to a seventh embodiment is the same as that of the first embodiment. The solid ink material of the seventh embodiment contains a plasticizer. For example, a composition of the ink composition layer 23 of the seventh embodiment is as follows:

| | |
|---|---|
| coloring agent: | Kayaset Black (product of Nippon Kayaku LTD) 1 part by weight; |
| low temperature melting compounds: | |
| urethane compound: | (product of Nippon Yushi LTD) 2 parts by weight; |
| fatty acid amide compound: | Diamid 0-200 (product of Nippon Kasei LTD), 0.5 parts by weight; |
| paraffin compound: | (product of Nippon Serio LTD) 1 part by weight; |
| filler: | carbon black (product of Nippon Kayaku LTD) 0.5 parts by weight; and |
| plasticizer: | (product of Daihachi Kagaku LTD) 0.3 parts by weight. |

The plasticizer includes, for example, phthalic acid esters such as dioctyl phthalate and diisodecyl phthalate, a fatty acid ester such as dioctyl azelate and dibutyl sebacate, maleic acid esters, fumaric acid esters such as dibutyl maleate and dioctyl fumalate, and orthophosphoric acid esters such as tributyl phosphate and trioctyl phosphate.

The same evaluating tests as those of the first embodiment were performed with a solid ink sheet according to the seventh embodiment under an environmental temperature ranging from 5° C. to 40° C. with satisfactory results. An optical density OD above 1.0 is achieved and a uniform printing image is attained on a Xerographic paper having a rough surface. Generally, at a low temperature, the portion of the ink composition layer 23 is heated to perform a thermal printing, and is apt to locally separate from the substrate 21 when the ink sheet is peeled off the associated printing paper after the printing operation. The thermal ink sheet according to the seventh embodiment overcomes the above problem. Further, a clear thermal image, is achieved with no ghost image and no background noise occurs at high temperatures.

Figure 12:
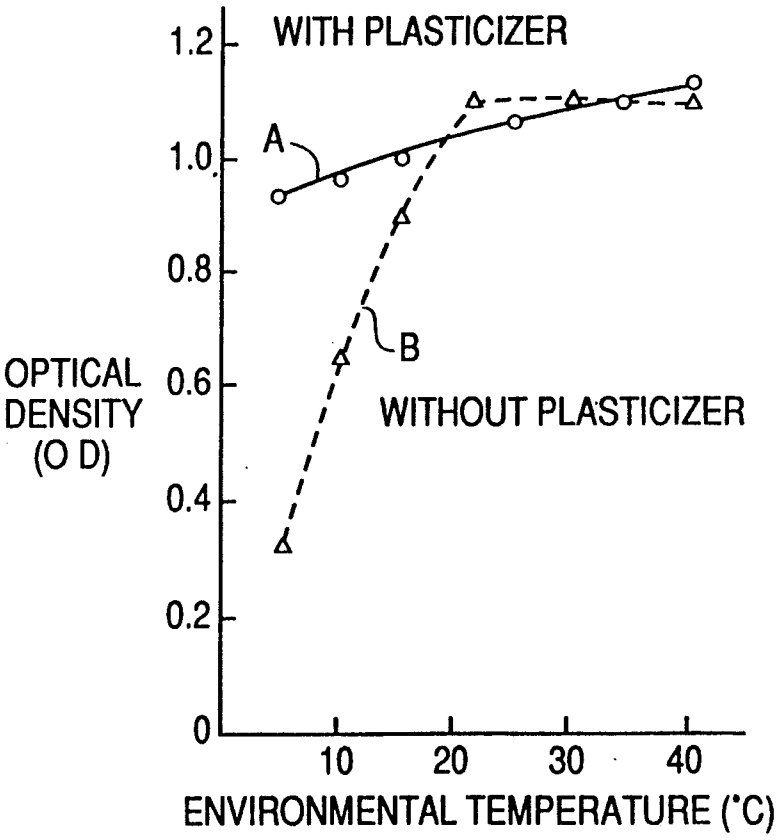
FIG. 12 is a graph of the characteristics of a solid ink material according to a seventh embodiment of the present invention, illustrating the relationship between temperature and the optical density OD of a printed image.

FIG. 12 is a graph of the relationship between the temperature and the optical density OD of a printed image when a solid ink material according to the seventh embodiment is employed. Curve A illustrates the characteristics of the ink material with the addition of a plasticizer (i.e., tributyl phosphate), and curve B illustrates the characteristics of the ink material without the addition of the plasticizer. From the curves A and B, the effect of the plasticizer for improving the optical density OD of the printed image at a lower temperature can be clearly seen. In fact, the addition of the plasticizer having a weight ratio below 3% is less effective for a cold environmental temperature.

Figure 13:
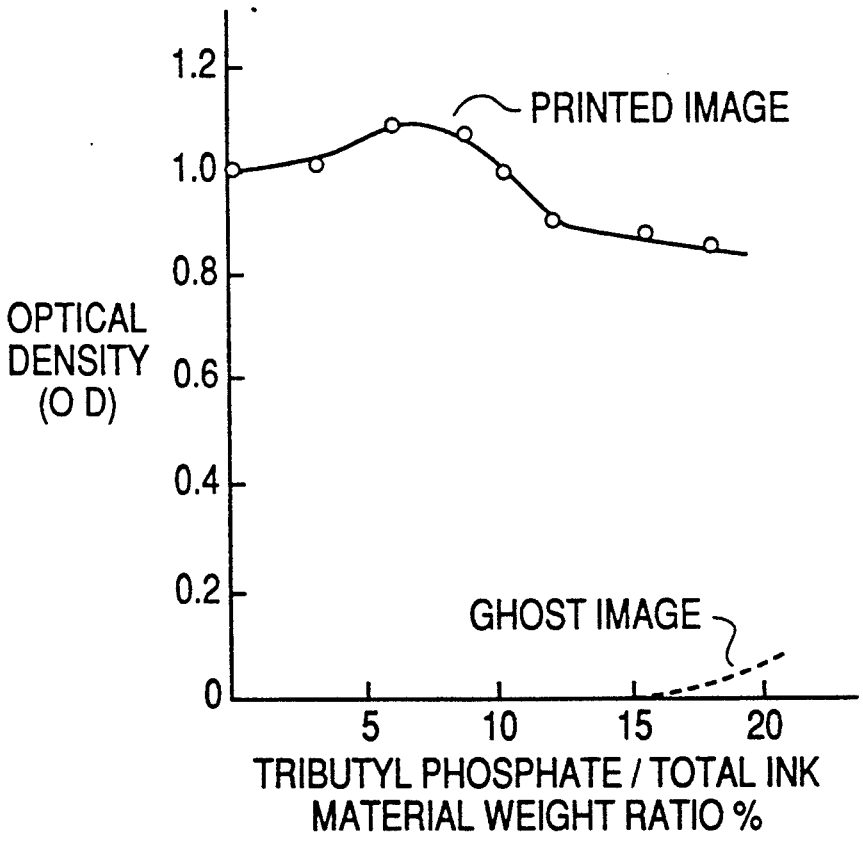
FIG. 13 is a graph of the characteristics of a solid ink material according to the seventh embodiment, illustrating the relationship between the content ratio of the plasticizer and the optical density OD of a printed image.

FIG. 13 is a graph of the characteristics of the solid ink material described above. FIG. 13 illustrates the relationship between the content of the plasticizer and the optical density 0D of the printed image. Thermal printing is performed at a room temperature of 22° C. As can be seen from the curve, a weight ratio lower than 3% of the plasticizer to the total solid ink material still has some effect when the thermal printing is performed at a fairly high temperature. As the additive ratio of the tributyl phosphate increases, the optical density OD tends to decrease, but the uniformity of the printed image is still good. However, with respect to ink materials having a ratio of plasticizer higher than 15%, this causes a storage problem at high temperatures. Consequently, the ink material containing a plasticizer having a ratio of plasticizer to ink material ranging from 3% to 15% is preferable.

The foregoing is considered as illustrative only of the principles of the invention. Further, since numerous modifications and changes will readily occur to those skilled in the art, it is not desired to limit the invention, and accordingly, all suitable modifications and equivalents may be resorted to, falling within the scope of the invention and the appended claims and their equivalents.

TABLE 1

Additive Materials to a Low Temperature Melting Compound

| N | name of additive compounds | material or trade name | OD | U | V |
|---|---|---|---|---|---|
| — | no addition | — | 0.70 | X | 150 |
| 1 | fatty acid amide | Diamid 0-200 | 1.06 | Δ | 130 |
| | | Alflow-P-10 | 1.13 | Δ | 128 |
| 2 | ester | carnauba | 1.18 | Δ | 110 |
| | | beeswax | 1.06 | Δ | 90 |
| 3 | fatty acid | palmitic acid | 0.91 | Δ | 50 |
| | | stearic acid | 0.88 | Δ | 55 |
| 4 | fatty acid amide/ester | Diamid 0-200/carnauba | 1.10 | O | 82 |
| | | Alflow-P-10/carnauba | 1.21 | O | 75 |
| | | Nikka Amide SO/carnauba | 1.12 | O | 50 |
| | | Diamid H/carnauba | 1.16 | O | 67 |
| | | Diamid 0-200/beeswax | 1.08 | O | 82 |
| | | Diamid 0-200/stearyl behenate | 1.05 | O | 36 |
| | | Diamid 0-200/Sugar Wax FA-10E | 1.02 | O | 40 |
| 5 | fatty acid/ ester | myristic acid/carnauba | 1.04 | O | 51 |
| | | palmitic acid/carnauba | 1.11 | O | 50 |
| | | stearic acid/carnauba | 1.02 | O | 51 |
| | | behenic acid/carnauba | 1.05 | O | 54 |
| 6 | fatty acid amide/fatty acid | Diamid 0-200/mylistic a. | 1.14 | O | 49 |
| | | Diamid 0-200/palmitic a. | 1.08 | O | 51 |
| | | Diamid 0-200/stearic a. | 1.20 | O | 52 |
| | | Diamid 0-200/behenic a. | 1.11 | O | 54 |

NOTE:
U: evaluation results of uniformity, O excellent, Δ fairly good, and X no good;
V: viscosity in CP (centipoise) at 75° C.;
OD: attainable optical density of the printed image;
N: number of relevant embodiment; and
a.: "acid."

What is claimed is:

1. A reusable ink sheet comprising:

a substrate;

an intermediate layer formed on said substrate; and an ink composition layer formed on said intermediate layer and including:

a coloring agent; and a low temperature melting material including:

a urethane compound; and an additive compound for modifying the viscosity of said uretane compound to a low viscosity, said additive compound having a weight ratio to said urethane compound of from 10% to 50% and comprising a material selected from the group consisting of: stearic acid, myristic acid, palmitic acid, behenic acid, oleic acid amide, erucic acid amide, N-stearyl oleic acid amide, ricinoleic acid amide, cerotic acid ester beeswax, stearyl behenate and cane sugar fatty acid ester.

2. A reusable ink sheet according to claim 1, wherein said intermediate layer is a material selected from the group consisting of polyester resin and polyamide resin.

3. A reusable ink sheet according to claim 1, wherein said low temperature melting material further comprises a plasticizer.

4. A reusable ink sheet according to claim 3, wherein aid plasticizer is selected from at least one element of the group consisting of phthalic acid esters, fatty acid esters, maleic acid fumaric acid esters, and orthophosphoric acid esters.

5. A reusable ink sheet for thermal printing according to claim 1, wherein said low temperature melting material further comprises a plasticizer.

6. A reusable ink sheet for thermal printing according to claim 5, wherein said plasticizer includes at least one material selected from the group consisting of phthalic acid esters, fatty acid esters, maleic acid, fumaric acid esters, and ortho phosphoric acid esters.

7. A reusable ink sheet for thermal printing according to claim 1, wherein said additive compound is a fatty acid having a weight ratio to said urethane compound of approximately 10% to 50%.

8. A reusable ink sheet for thermal printing according to claim 1, wherein said additive compound is a fatty acid amide having a weight ratio to said urethane compound of approximately 10% to 50%.

9. A reusable ink sheet for thermal printing, comprising:

a substrate; and a thermal ink composition layer, comprising an ink material, formed on said substrate, said ink material including:

a coloring agent;

a filler material; and a low temperature melting material which is in a solid state at room temperature and is melted when heated, said low temperature melting material comprising: a mixture of a urethane compound and an ester as a viscosity modifying material for said urethane compound, said ester being selected from the group consisting of cerotic acid ester, beeswax, stearyl behenate and cane sugar fatty acid ester, the weight ratio of said ester to said urethane compound ranging from approximately 10% to 50%.

10. A reusable ink sheet for thermal printing according to claim 9, wherein said low temperature melting material further comprises a fatty acid.

11. A reusable ink sheet for thermal printing according to claim 10, wherein said fatty acid includes an alkyl group and wherein the number of carbon atoms in the alkyl group in said fatty acid ranges from twelve to twenty-four.

12. A reusable ink sheet for thermal printing according to claim 10, wherein said weight ratio of each one of said fatty acid and said ester compound to said urethane compound ranges from approximately 10% to 50%.

13. A reusable ink sheet for thermal printing comprising a substrate; and a thermal ink composition layer, comprising an ink material, formed on said substrate, said ink material including:

a coloring agent;

a filler material; and a low temperature melting material which is in a solid state at room temperature and is melted when heated, said low temperature melting material comprising: a mixture of a urethane compound and a fatty acid amide compound as a viscosity modifying material for said urethane compound, said fatty acid amide compound being selected from the group consisting of oleic acid amide, erucic acid amide, N-stearyl oleic acid amide and ricinoleic acid amide, the weight ratio of said fatty acid amide compound to said urethane compound ranging from approximately 10% to 50%.

14. A reusable ink sheet for thermal printing according to claim 13, wherein said low temperature melting material further comprises a fatty acid.

15. A reusable ink sheet for thermal printing according to claim 14, wherein said fatty acid includes an alkyl group and wherein the number of carbon atoms in the alkyl group in said fatty acid ranges from twelve to twenty-four.

16. A reusable ink sheet for thermal printing according to claim 14, wherein said weight ratio of each of said fatty acid amide compound and said fatty acid to said urethane compound ranges from approximately 10% to 50%.

17. A reusable ink sheet for thermal printing according to claim 13, wherein said low temperature melting material further comprises an ester compound selected from the group consisting of cerotic acid ester, beeswax, stearyl behenate and cane sugar fatty acid ester.

18. A reusable ink sheet for thermal printing according to claim 17, wherein the weight ratio of each of said fatty acid amide compound and said ester compound to said urethane compound ranges from approximately 10% to 50%.

19. A reusable ink sheet for thermal printing, comprising:

a substrate; and a thermal ink composition layer, comprising an ink material, formed on said substrate, said ink material including:

a coloring agent;

a filler material; and a lower temperature melting material which is in a solid state at room temperature and is melted when heated, said low temperature melting material comprising: a mixture of a urethane compound and a fatty acid as a viscosity modifying material for said urethane compound, said fatty acid selected from the group consisting of stearic acid, myristic acid, palmitic acid and behenic acid.

* * * * *

UNITED STATES PATENT AND TRADEMARK OFFICE

CERTIFICATE OF CORRECTION

PATENT NO. : 5,227,246

DATED : July 13, 1993

INVENTOR(S) : Ueda et al.

It is certified that error appears in the above-indentified patent and that said Letters Patent is hereby corrected as shown below:

Title page, item [56] References Cited, under Other Publications, line 2, "Abstrcacts" should be --Abstracts--; and line 8, "Patents" should be --Patent--.

Col. 2, line 30, "printinu." should be --printing.--.

Col. 3, line 32, "proposed." should be --proposed in Japanese Patent Laid-Open Provisional Publication No. 58-199195 to Kuroda et al., published on November 19, 1993, upon which U.S. Patent No. 4,505,983 issued on March 19, 1985.--.

Col. 9, line 43, "acid" should be --acids--.

Col. 11, line 23, delete "esters," (first occurrence).

Col. 12, line 64, "ester" should be --ester,--.

Col. 13, line 5, "aid" should be --said--.

Signed and Sealed this

Twenty-eighth Day of June, 1994

*Attest:*

Bruce Lehman

BRUCE LEHMAN

*Attesting Officer*

*Commissioner of Patents and Trademarks*